United States Patent [19]

Greenberger

[11] 4,047,985

[45] Sept. 13, 1977

[54] METHOD AND APPARATUS FOR SYMMETRICALLY COOLING HEATED WORKPIECES

[75] Inventor: Joseph Irwin Greenberger, Pittsburgh, Pa.

[73] Assignee: Wean United, Inc., Pittsburgh, Pa.

[21] Appl. No.: 656,689

[22] Filed: Feb. 9, 1976

[51] Int. Cl.[2] ..... C21D 01/00

[52] U.S. Cl. ..... 148/153; 148/156; 266/114; 72/201; 164/89; 164/283 S

[58] Field of Search ..... 72/13, 201; 266/82, 266/87, 114; 164/4, 89, 126, 128, 154, 269, 283 S, 348; 148/153, 156

[56] References Cited

U.S. PATENT DOCUMENTS

| | | | |
|---|---|---|---|
| 2,726,430 | 12/1955 | Rossi et al. | 164/4 X |
| 3,151,197 | 9/1964 | Schultz | 72/201 X |
| 3,589,160 | 6/1971 | Gruver et al. | 72/201 |
| 3,779,054 | 12/1973 | Greenberger | 72/201 X |
| 3,856,281 | 12/1974 | Bertolotti et al. | 266/3 R |
| 3,877,510 | 4/1975 | Tegtmeier et al. | 164/89 X |
| 3,880,358 | 4/1975 | Schaming | 72/201 X |
| 3,897,230 | 7/1975 | Taylor et al. | 164/283.5 X |
| 3,905,216 | 9/1975 | Hinrichsen | 72/201 X |

OTHER PUBLICATIONS

P. M. Auman et al., "Hot Strip Mill Runout Table Temperature Control," Iron and Steel Engineer, Sept. 1967, pp. 174–181.

F. Hollander, "Design and Control for Advanced Runout Table Processing," Iron and Steel Engineer, Mar., 1971, pp. 81–92.

*Primary Examiner*—Ronald J. Shore

*Attorney, Agent, or Firm*—Daniel Patch; Suzanne Kikel

[57] ABSTRACT

The disclosure pertains to an arrangement for cooling a heated workpiece, such as, strip or slab as it issues from a rolling mill or continuous slab caster. The longitudinally moving workpiece is caused to pass between a number of coolant discharge headers arranged above and below the workpiece in which, during its cooling, the coolig rates of the upper and lower surfaces of the workpiece differ. The effective discharge of the headers is varied to equalize the cooling rates of the upper and lower surfaces of the workpiece to symmetrically cool the workpiece.

2 Claims, 4 Drawing Figures

SLAB TEMPERATURE PROFILE AFTER LAMINAR STREAM

Figure 1:
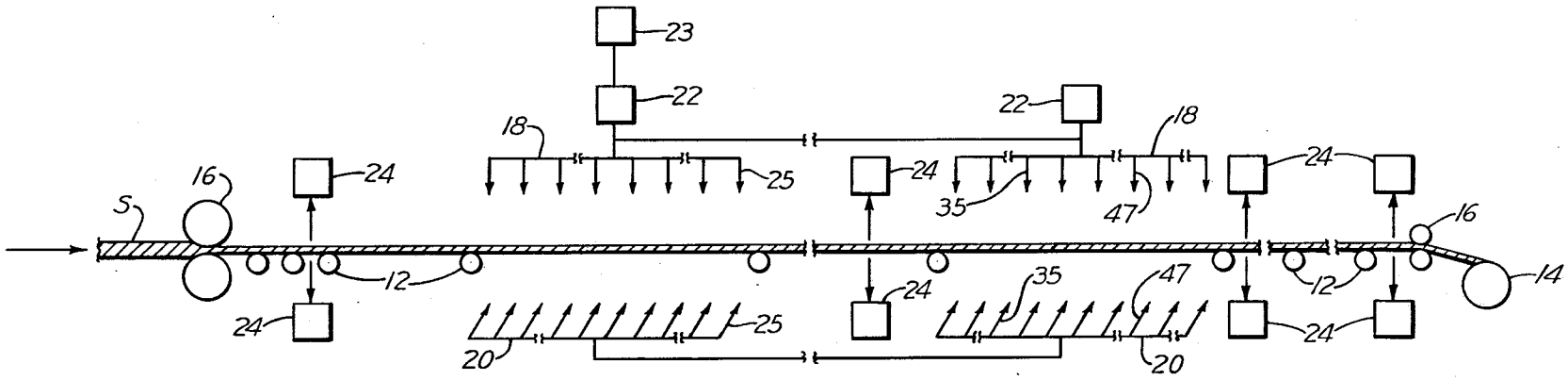

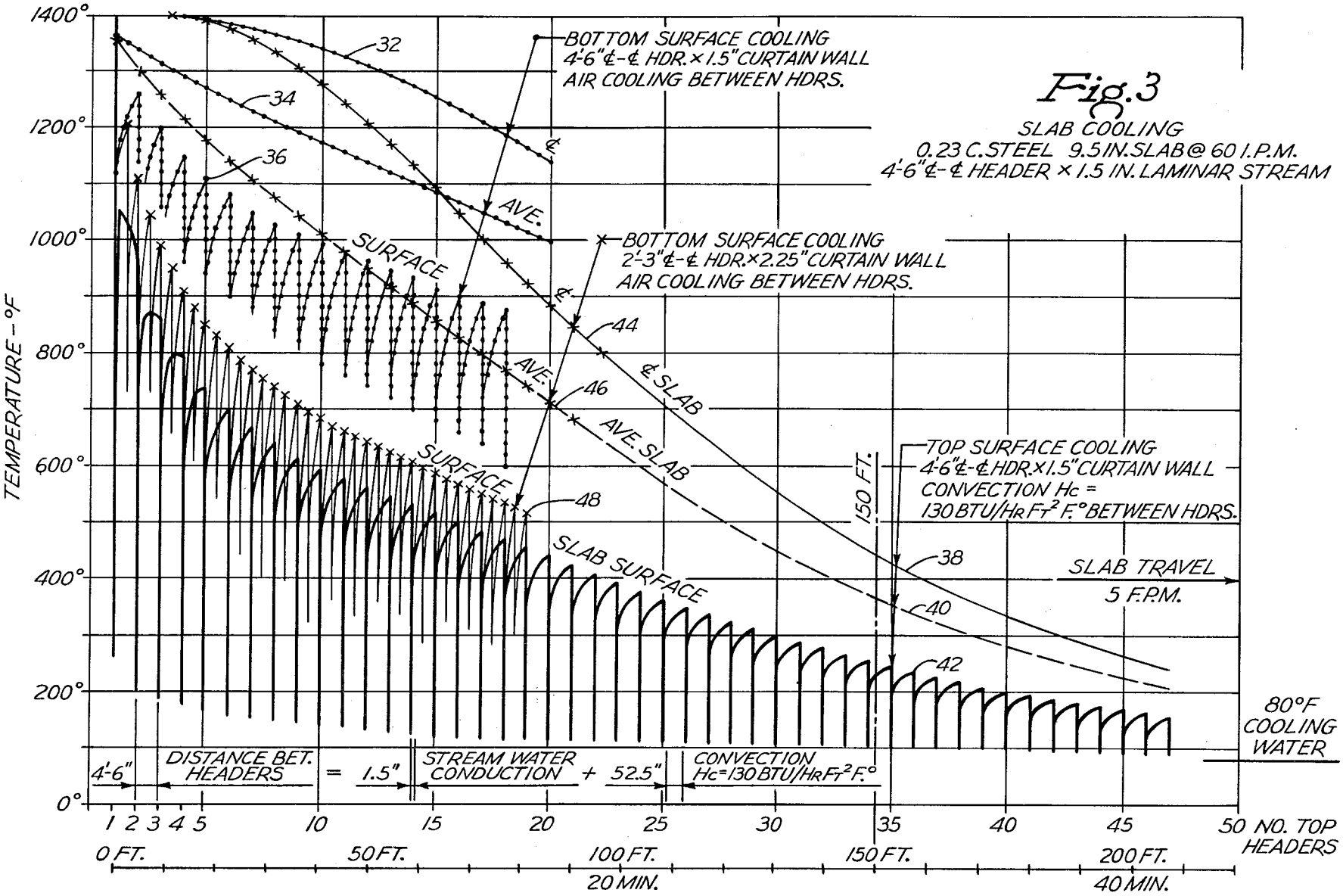
Fig. 3
SLAB COOLING
0.23 C. STEEL 9.5 IN. SLAB @ 60 I.P.M.
4'-6" ℄-℄ HEADER × 1.5 IN. LAMINAR STREAM
BOTTOM SURFACE COOLING
4'-6" ℄-℄ HDR. × 1.5" CURTAIN WALL
AIR COOLING BETWEEN HDRS.
BOTTOM SURFACE COOLING
2'-3" ℄-℄ HDR. × 2.25" CURTAIN WALL
AIR COOLING BETWEEN HDRS.
TOP SURFACE COOLING
4'-6" ℄-℄ HDR. × 1.5" CURTAIN WALL
CONVECTION Hc =
130 BTU/HR FT² F.° BETWEEN HDRS.
SLAB TRAVEL
5 F.P.M.
80°F
COOLING
WATER
50 NO. TOP
HEADERS
150 FT.
℄ SLAB
AVE. SLAB
SURFACE
AVE.
SLAB SURFACE
32
34
36
38
40
42
44
46
48
DISTANCE BET.
HEADERS
4'-6"
= 1.5"
STREAM WATER
CONDUCTION
+ 52.5"
CONVECTION
Hc = 130 BTU/HR FT² F.°
0 FT.
50 FT.
100 FT.
150 FT.
200 FT.
20 MIN.
40 MIN.
TEMPERATURE - °F
1400°
1200°
1000°
800°
600°
400°
200°
0°

METHOD AND APPARATUS FOR SYMMETRICALLY COOLING HEATED WORKPIECES

The production of hot metal products, such as, mild carbon steel, slabs, strip, sheets and plates, that will meet the quality requirements of certain ultimate use has always been a problem and presently is becoming more serious. Two areas where present production practices are under serious study are in the cooling of continuous cast slabs and the cooling of continuous hot rolled strip or plate.

In referring to a typical modern continuous hot strip mill, the hot finally rolled strip on leaving the mill is directed to a runout table arranged between the mill and the coilers provided to form the strips into coils. The table includes spaced-apart driven rollers for supporting the bottom surface of the strips as they pass in an horizontal direction from the mill to the coilers. Associated with the runout table is a runout cooling system which may include a number of sprays or laminar type cooling headers for cooling the top surface of the strips and a series of sprays for cooling the bottom surface of the strips. The bottom sprays usually perform the dual function of cooling not only the bottom strip surface, but also furnishing cooling for the rollers of the runout table. Because of the horizontal disposition of the strip during it conveyance and its contact with the table rollers, different cooling rates are involved in cooling the upper and lower surfaces of the strip which under past rolling mill practice result in non-symmetrical cooled strip with reference to its cross-section thickness. While for very thin gauge strip, such as, strip thickness below 5/16 inch, this condition has little or no adverse metallurgical effects, for gauges from 5/16 inch or ⅜ inch minimum and heavier, the resultant substantial non-symmetrical temperature profile and non-symmetrical microstructure can be seriously objectionable in certain important ultimate uses of the rolled product. For example, in strip produced for welded pipe, the non-symmetrical microstructure and physical properties result in various forming difficulties.

Ideally, a symmetrical hot rolled microstructure is highly desirable, if not mandatory in certain cases. What has been noted above with reference to the production of hot strip applies with equal force to slabs produced by a continuous casting machine or slabbing mill. Here, however, the concern is also distortion of the slabs, i.e., bending or bowing due to the unequal cooling which creates problems in subsequent handling and processing of the slabs.

Another serious problem that has always existed in cooling hot products, such as, strip and slabs, is the inability in the past to obtain the highest possible cooling efficiency from the water headers or sprays. In the remote past, and to a limited extent even today, high pressure sprays were employed to cool the top and bottom surfaces of the workpiece. More recently, when cooling strip low pressure laminar nozzles have been used to cool the top of the strip while sprays were still employed for cooling the lower surface of the strip. While from a cooling rate standpoint and efficient use of the coolant the laminar type system is preferred, there is still a great need for improvement in order to reduce the overall cooling cost and the length of the runout table. It must be kept in mind with reference to the immediate preceding remarks that a modern strip mill is designed to roll a wide range and variety of products having a wide range of thicknesses which place great demands on the capacity, application and flexibility of the runout cooling system.

In referring to the non-symmetrical profile cooling condition that takes place in cooling heated elongated upper and lower surfaces of workpieces when moving in an horizontal path of travel through a cooling station, reference will now be made to a study conducted in regard to cooling the upper and lower surfaces of a 9½ inches thick 0.23 carbon steel slab by employing a water curtain wall cooling discharge header system. The details of this particular type of header system will be given later since such information is not necessary to understand the present discussion or the conclusion drawn concerning the non-symmetrical profile cooling of the upper and lower halves of the slab.

The speed of the slab was 60 inches per minute and its upper surface was subject to a 1½ inches thick curtain wall of the coolant over its entire width to expose the surface to conduction type cooling by water at a temperature of 80° F. The resultant cooling was computed based on a single curtain wall of water and the period that the slab would have traveled to the next header spaced at 4 feet 6 inches centers. The result was a sharp drop in the surface temperature after passing through the curtain wall. Between top headers, the water flowing on top of the slab surface was estimated to result in an effective surface coefficient of 130 BTU/FT$^2$, HR F°.

Now, as to the cooling of the bottom surface of the slab in employing the same parameters, except that the bottom surface contacts the table rollers and does not have the "water pooling" effect associated with the top surface, the calculated effective surface coefficient, which closely approximates normal radiation and convection, was estimated to be below 20 BTU/FT$^2$, HR F°. This is substantially below the 130 BTU/FT$^2$HR F° estimated for the cooling of the upper surface. This study demonstrates that the bottom cooling system using the same header centers and same curtain wall thickness cools much more slowly than the upper header system because of lower heat loss coefficient between headers.

In light of the foregoing, it is an object of the present invention to provide a method and means for symmetrically cooling the cross-sectional thickness of a relatively thick elongated heat workpiece while moving over a generally horizontal path of travel.

It is another object of the present invention to provide a method and means for cooling an elongated heated metallic workpiece so that the cross-sectional thickness thereof is symmetrically cooled as it moves longitudinally over a given path of travel, supporting by spaced-apart means the lower surface of said workpiece while passing over said given path of travel, causing the workpieces while so supported to pass between upper and lower coolant discharge headers to subject the corresponding upper and lower halves of the workpiece to cooling, during which cooling the lower half of the workpiece has a different cooling rate than the upper half, and varying the coolant capacity of at least one of said headers with reference to the other header to vary the coolant rate of the corresponding half of the workpiece in order to substantially equalize the cooling rates of the upper and lower halves of the profile.

A still further object of the present invention is to provide a means and method in accordance with the immediate previous object of providing a number of headers on both sides of said path of travel for said upper and lower halves of the workpiece to effect said cooling and providing headers for cooling the lower half in a manner to increase the cooling rate of the lower half in comparison with the cooling rate of the upper half.

A further object of the present invention is to provide a means in accordance with any of the previous objects of determining any difference in the temperatures of the upper and lower halves of the workpiece and in accordance with said determination adjusting the output of at least one of said headers to substantially equalize the cooling rates of said upper and lower halves.

A still further object of the present invention is to provide a means and method in accordance with any of the previous objects, including providing a curtain wall of coolant from at least the lower header and, if desired, varying the cross-section thickness of the curtain wall to vary the coolant rate of the lower half of the workpiece.

Figure 4:
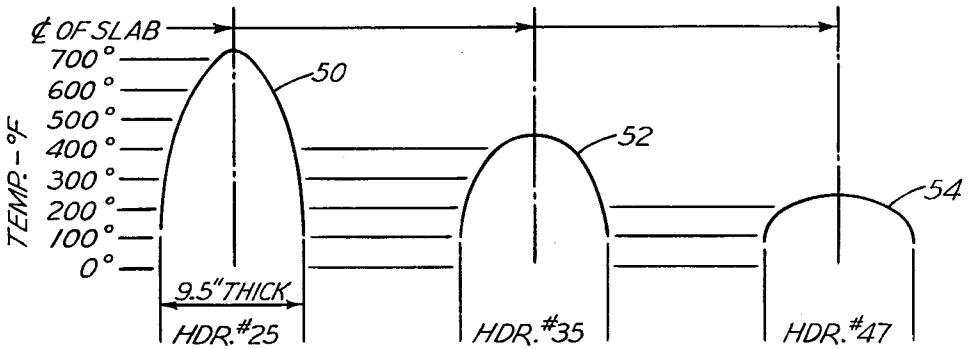
Figure 2:
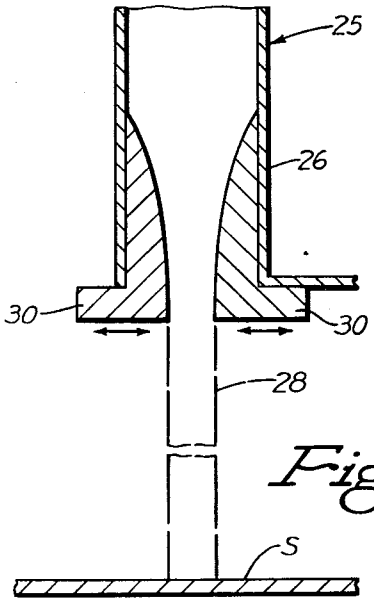

These objects, as well as other novel features and advantages of the present invention, will be better understood when the following description of one embodiment thereof is read along with the accompanying drawings of which:

FIG. 1 is a diagrammatic elevational view of a runout station for a continuous hot strip rolling mill, FIG. 2 is an enlarged elevational view, partly in section, of the lower portion of one of the cooling headers illustrated in FIG. 1, and FIG. 3, is a composite temperature curve of various relationships existing and imposed in the cooling of a heated slab, and FIG. 4 illustrates three temperature profile curves of the slab of FIG. 3 at three different points during its cooling.

In referring first to FIG. 1 there is schematically illustrated a strip S passing between the rolls 10 of the last stand of a hot strip rolling mill. The strip, as it leaves the mill, passes over a runout table 12 on its way to be formed into a coil by a downcoiler 14. Adjacent the downcoiler 14 there is provided a pinch roll unit 16. Between the mill rolls 10 and the pinch roll unit 16 is a runout cooling system consisting of a number of banks of water discharging header assemblies, only two upper header assemblies 18 and two lower header assemblies 20 being shown in the drawing. The equipment and arrangement above described are well known in the art so that no further discussion is deemed necessary.

The present invention is concerned with the character or form of the water discharge from the header assemblies to the strip and the application of the water on the strip, including the differentiation of the application and rate of cooling thereof with respect to the upper and lower halves of the strip.

To complete the identification of the elements shown in FIG. 1, the upper header assemblies 20 are provided with flow control units 22 and a master control 23, as are the lower header assemblies 20, although not shown, all in accordance with well known practice. The elements 24 represent temperature measuring devices, such as, radiation pyrometers, for measuring the upper and lower surface temperatures of the strip, about which more will be said later.

While the header assemblies 18 and 20 may be designed to admit water under high pressure in well known forms, such as, sprays or jets, or in equally well-known form of rod columns of laminar flow by the header assembly 18 and sprays or jets from the header assemblies 20 in which equalization of the upper and lower surface cooling rates can be achieved, it has been found that a substantially more efficient use of the coolant can be achieved by providing at least for one of the header assemblies and, preferably, for both, a laminar curtain wall condition. The establishment and maintenance of effective laminar flow cooling is well known and in existence at the present time and for this reason needs no detailed explanation.

In FIG. 2 there is shown a lower end of one of the discharge openings of an individual header 25 of the header assemblies 18 and 20 comprising a discharging portion 26 of the header 25, into which non-turbulent water is introduced from an entry portion (not shown) of the header 25 and which forms a curtain or wall of laminar water as indicated diagrammatically in exaggerated form at 28. The discharge opening 26 illustrated in FIG. 2 represents one of the upper headers 25 of the assemblies 18 for which reason the curtain wall 28 is shown contacting the upper surface of the strip S.

While the net effective output of the header, in the usual way can be varied by varying the pressure or volume as by adjusting the units 22 and/or 23, the output can also be adjusted by adjusting the width of the curtain wall of water. This wall in a solid laminar form which extends the full width of the maximum strip roll by the mill can be very simply adjusted to vary its thickness by moving the outlet members 30 arranged at the lower end of the headers 25 of the header assemblies 18 and 20, this movement being indicated by arrows in FIG. 2. As will be noted below, this adjustment of the thickness of the curtain wall can be made to compensate, at least in part, for the unequal cooling rates of the upper and lower halves of the strip. In FIG. 3 two examples of the coolant curtain wall thicknesses are given as 1.5 inches and 2.25 inches.

In still referring to FIG. 3, the composite temperature curve is designed to illustrate the differential temperature of the top and bottom surfaces of a heated slab and how an equalization of the cooling rates for the two surfaces can be brought about. As noted, FIG. 3 plots temperature against distance and time traveled by the slab and the number of headers 25 that it has passed by. The parameters of the slab and other ancillary data have been previously set forth and are also repeated in FIGS. 3 and 4.

In first comparing curves 32, 34 and 36 representing as legended the bottom surface cooling with 4 feet 6 inches center line headers and a 1.5 inches thickness curtain wall of water with curves 38, 40 and 42 which represent the top surface with the same header spacing and curtain wall thickness, the substantial differential in temperature during the first 150 ft. and 30 minutes is apparent.

Just as apparent is the ability to substantially reduce this differential in temperature by changing the bottom headers to 2 feet 3 inches centers; thereby, increasing the number of headers in the given length as indicated in FIG. 1 and employing a 2.25 inches curtain wall thickness. The three curves 44, 46 and 48 represent the three common reference points of the slab for the changed condition. The curves 36, 42 and 48 indicate also the bloom-back temperature effect as the slab travels between headers. While the curves in FIG. 3 illustrate that the top and bottom surface differential can be substantially equalized by changing the headers spacing and the number of the headers and the thickness of the coolant wall, other alternatives can be employed to vary the net cooling rate of the two sides of the workpiece, such as already noted, the pressure and volume of the header assemblies 18 and 20.

FIG. 4 further illustrates in three curves 50, 52 and 54 the temperature profiles of the slab under the conditions reflected by curves 38 – 42 and 44 – 48 as the slab leaves the upper and lower headers 25, 35 and 47, respectively, which are identified in FIG. 1.

Where curtain wall cooling is used for the lower headers, in order to avoid the water from falling back on the stream and thereby disturb the stream, the discharge members 26 of FIG. 2 are tilted at a slight angle in from the vertical to the direction of travel of the heated workpiece as can be clearly seen in FIG. 1.

As noted before, in some operations it is desirable to automatically control the application of the coolant to achieve the optimum temperature equalization. For this reason there is provided in FIG. 1 temperature measuring devices 24, which in combination with a coolant flow control system can vary the net cooling output of the headers to assure a temperature equalization of the opposite halves of the workpiece. As is customary in such systems, they may involve a feed forward and a feed back control system, the latter functioning as a vernier control in combination with the last pyrometer shown in FIG. 1. While in the preferred form of the present application the heated workpiece has been noted as continuously moving along a given path during the cooling thereof, it will be appreciated that the application of equal cooling rates for the upper and lower halves of the heated workpiece may be applicable to cooling heated workpieces in a stationary position.

In accordance with the provisions of the patent statutes, I have explained the principle and operation of my invention and have illustrated and described what I consider to represent the best embodiment thereof.

I claim:

1. In a method of cooling a heated elongated metallic workpiece so that the cross-sectional thickness thereof is symmetrically cooled as it assumes a longitudinal position, supporting by spaced-apart means the lower surface of said workpiece while in said assumed position, causing the workpiece while so supported to pass between upper and lower coolant discharge headers to subject the corresponding upper and lower halves of the workpiece to cooling, during which the upper and lower cooled halves of the workpiece have different cooling rates, causing the discharge of said upper and lower headers to take the form of a rectangular cross-sectional laminar wall of coolant at the point where the coolant contacts the workpiece, and varying the cross-sectional thickness of the wall of coolant of said lower header to vary the coolant rate of the lower half of said workpiece in comparison with the cooling rate of the upper half thereof, to substantially equalize the cooling rate of both halves.

2. In an apparatus for cooling a heated elongated metallic workpiece so that the cross-sectional thickness thereof is symmetrically cooled as it assumes a longitudinal position in a given path of travel, spaced-apart means for supporting the lower surface of said workpiece while in said assumed position, means for arranging a number of headers on both sides of said path of travel for said upper and lower surfaces of the workpiece so that the workpiece while so supported, passes therebetween to subject the corresponding upper and lower halves of the workpiece to cooling, during which the upper and lower cooled halves of the workpiece have different cooling rates, means for causing the discharge of said upper and lower headers to take the form of a rectangular cross-sectional laminar wall of coolant at the point where the coolant contacts the workpiece, and means for varying the cross-sectional thickness of said wall of coolant of said lower header to vary the coolant rate of the lower half of said workpiece in comparison with the cooling rate of the upper half thereof, in order to substantially equalize the cooling rates of both halves.

* * * * *